US007800574B2

(12) United States Patent
Yamashita

(10) Patent No.: US 7,800,574 B2
(45) Date of Patent: Sep. 21, 2010

(54) LIQUID CRYSTAL DISPLAY DEVICE

(75) Inventor: Masakatsu Yamashita, Tokyo (JP)

(73) Assignee: TPO Hong Kong Holding Limited, Shatin (HK)

( * ) Notice: Subject to any disclaimer, the term of this patent is extended or adjusted under 35 U.S.C. 154(b) by 760 days.

(21) Appl. No.: 11/578,156

(22) PCT Filed: Apr. 4, 2005

(86) PCT No.: PCT/IB2005/051100

§ 371 (c)(1),
(2), (4) Date: Jun. 22, 2007

(87) PCT Pub. No.: WO2005/098809

PCT Pub. Date: Oct. 20, 2005

(65) Prior Publication Data

US 2008/0094341 A1 Apr. 24, 2008

(30) Foreign Application Priority Data

Apr. 12, 2004 (JP) ..... 2004-116475

(51) Int. Cl.
*G09G 3/36* (2006.01)

(52) U.S. Cl. ..... 345/98; 345/545

(58) Field of Classification Search ..... None
See application file for complete search history.

(56) References Cited

U.S. PATENT DOCUMENTS 6,486,930 B1 11/2002 Kwon
6,559,839 B1 * 5/2003 Ueno et al. ..... 345/213

FOREIGN PATENT DOCUMENTS

| | | | |
|---|---|---|---|
| CN | 1281155 | A | 1/2001 |
| EP | 0 368 572 | A2 | 5/1990 |
| EP | 1 069 457 | A1 | 1/2001 |
| WO | WO-03/030137 | A2 | 4/2003 |
| WO | WO 03030137 | A2 * | 4/2003 |

* cited by examiner

*Primary Examiner*—Alexander Eisen
*Assistant Examiner*—Robin Mishler
(74) *Attorney, Agent, or Firm*—Birch, Stewart, Kolasch & Birch, LLP

(57) ABSTRACT

It is an object of the invention to provide a liquid crystal display device that can realize a driving method reducing the power consumption of a driving circuit in a condition that real-time processing is available. In a liquid crystal display device, SW1 is controlled such that pixel data on odd lines are written in a first RAM (12), pixel data on even lines are written in a second RAM (13) for ist line to 11th line, and pixel data on 12th line are transferred to a latch circuit (14) directly. In a liquid crystal display device, SW1 is controlled such that pixel data on odd lines are written in the second RAM (13), pixel data on even lines are written in the first RAM 12 for 13th line to 23rd line, and pixel data on 24th line are transferred to a latch circuit (14) directly. Pixel data written in the first and second RAMs (12, 13) are output to source driver (15), which performs time-series operating process, through the latch circuit (14).

4 Claims, 3 Drawing Sheets

LIQUID CRYSTAL DISPLAY DEVICE

TECHNICAL FIELD

The present invention relates to a liquid crystal display device for driving pixels arranged in form of rows and columns or in form equivalent thereto (hereinafter, simply referred to as 'in matrix') in accordance with an image to be displayed.

BACKGROUND ART

Conventionally, a so-called AC driving method is applied to many active matrix type liquid crystal display devices. This technique provides countermeasures against a deterioration phenomenon that when liquid crystal is driven by a DC for an extended period of time, material properties of the liquid crystal change and its resistivity decreases, by alternating the polarity of a drive voltage applied to the liquid crystal frame by frame, a more detailed and basic operation of which is disclosed on pages 69 to 74 of 'Liquid Crystal Display Technology—Active Matrix LCD' (Shoichi Matsumoto, Nov. 14, 1997, $2^{nd}$ impression, Sangyotosho Publishing Co., Ltd.), etc.

According to this AC driving method, flickering would originally occur when the polarity alternating frequency of the drive voltage becomes half of the frame frequency, but by spatially and temporally averaging the polarity alternation within a screen, the fundamental wave component of optical response ripple is set to equivalent to or greater than the frame frequency, thus preventing flickering (visible flickering). More specifically, drive voltage polarities of pixels adjacent to (or pixel row or pixel column adjacent to) an arbitrary one pixel are differentiated from one another and their polarities are alternated frame by frame.

Since this AC driving method has a high polarity alternation rate of the drive voltage, there is a problem that the driving circuit requires great power consumption. The present inventor proposed to change an output sequence of image data from a source driver using a RAM to solve this problem in Unexamined Japanese Patent Publication No. 2003-114647.

DISCLOSURE OF INVENTION

Technical Problem

However, a RAM of an ordinary arrangement has display area addresses and RAM map addresses in pairs. Realizing this method using this ordinary RAM requires one or more frame memories. This prevents reducing the area of an IC chip and makes it difficult to realize cost reduction.

Real-time processing is indispensable for an interface such as an RGB interface (I/F) required for displaying moving images. However, realizing the above-described method using one or more frame memories makes real-time processing more difficult.

The present invention has been implemented to solve such problems and it is an object of the present invention to provide a liquid crystal display device that can realize a driving method reducing the power consumption of a driving circuit in a condition that real-time processing is available.

Technical Solution

A liquid crystal display device according to the present invention for matrix driving to alternately drive pixels arranged in matrix, wherein a plurality of row electrodes extending in a horizontal direction of a display screen are made to be selectively active for each horizontal scanning period of images to be displayed; a plurality of column electrodes extending in a vertical direction of the display screen are supplied with respective pixel data which are correspond to the image and relevant to the horizontal scanning period while the pixel data have polarities alternating for each frame period of the images; and the pixel data have polarities alternating in the vertical direction spatially in a display area within the frame period is characterized in that the device comprises:

a plurality of storing means for storing the pixel data relevant to row electrodes having the same polarities;

latch means to which the pixel data are transferred; and timing control means for controlling the timing such that the pixel data relevant to row electrodes having the same polarities are written in said plurality of storing means or said latch means, wherein matrix driving is performed in such a way that the device is successively sequencing on a time series a supply timing of pixel data for one row electrode and a supply timing of pixel data for the other row electrode having the same polarities as the pixel data for the one row electrode, and activates the relevant row electrode in response to each of the supply timings of the pixel data for the one and the other row electrodes.

According to this arrangement, it is possible to output the same polarities successively to the source driver and realize a time-series operation process. This reduces power consumption during matrix driving. Furthermore, since image data are output to the source driver efficiently using a plurality of storing means, it is possible to perform processing in real time compared to the conventional method in which the overall frame is latched into a latch circuit and then output to the source driver. Furthermore, since one frame memory is not necessary, it is possible to reduce the area of the IC chip.

In the liquid crystal display device of the present invention, the timing control means preferably comprises counter means for counting horizontal synchronizing signal, and judging means for judging the destination of the pixel data on the basis of a count value of the horizontal synchronizing signal from the plurality of storing means and latch means.

In the liquid crystal display device of the present invention, each of the plurality of storing means preferably has the capacity that is able to store the image data corresponding in number to successive lines of supply timing of the image data.

Advantageous Effects

According to the present invention, a plurality of storage sections are capable of storing pixel data all together relevant to row electrodes having the same polarity, write timings can be controlled so as to store pixel data all together relevant to the row electrodes of the same polarity, output timings can be controlled for a time-series operation process, and thereby the time-series operation process is capable of realizing low power consumption in real time. Furthermore, according to the present invention, the area of the storage section can be reduced, and the area of the IC chip can be thereby reduced.

BEST MODE

An essence of the present invention is that in a case that matrix driving is performed in such a way that the device is successively sequencing on a time series a supply timing of pixel data for one row electrode and a supply timing of pixel data for the other row electrode having the same polarities as the pixel data for the one row electrode, and activates the relevant row electrode in response to each of the supply timings of the pixel data for the one and the other row electrodes (hereinafter referred to as 'time-series operation process'), the pixel data relevant to row electrodes having the same polarities are stored all together in a plurality of storage sections, write timings are controlled so as to store pixel data all together relevant to the row electrodes of the same polarity, output timings are controlled for the time-series operation process and the time-series operation process in real time is capable of realizing low power consumption.

Figure 1:
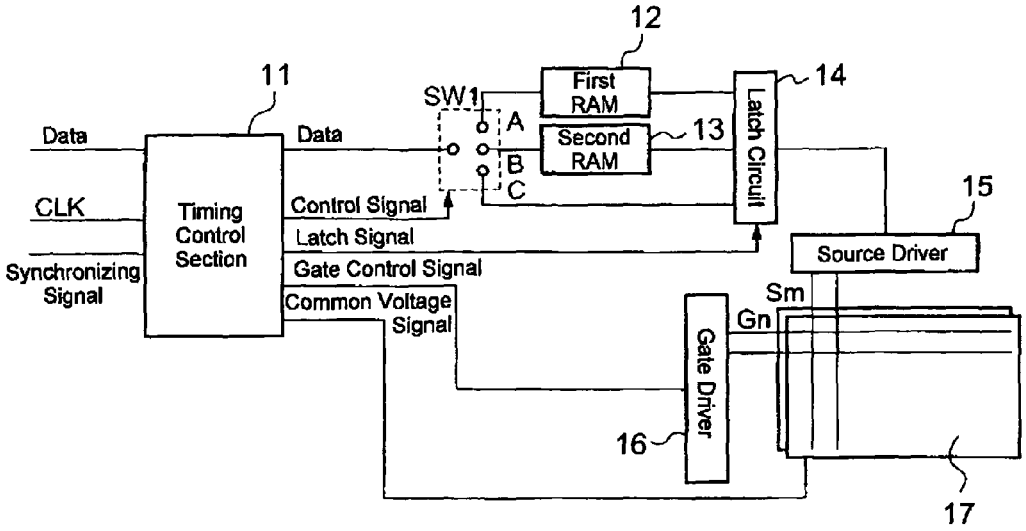
FIG. 1 is a block diagram showing an arrangement of a liquid crystal display device according to an Embodiment of the present invention.

FIG. 1 is a block diagram showing an arrangement of a liquid crystal display device according to an Embodiment of the present invention. In FIG. 1, this liquid crystal display device is provided with a driving circuit which drives a display panel 17 of an active matrix type liquid crystal display (LCD) device in which, for example, a field-effect thin-film transistor (TFT) is disposed for each pixel as an active element for driving the pixel within a predetermined display area.

In the display panel 17, TFTs are arranged in matrix with Y rows and X columns and gate electrodes of the TFTs are connected to gate bus lines which run in parallel for every row in a horizontal direction through the display area and source electrodes of the TFTs are connected to source bus lines which run in parallel for every column in a vertical direction through the display area. Drain electrodes of the TFTs are connected to pixel electrodes individually and individual pixel areas are basically delimited by these pixel electrodes.

The display panel 17 is also provided with common electrodes which are disposed facing the pixel electrodes at a certain distance therefrom. A liquid crystal material is sealed in between the pixel electrode and common electrode and the common electrode extends over the entire area of the display area. The TFTs are selectively turned ON for each row by a gate control signal applied through the gate bus line. On the other hand, the TFTs which have been turned ON are set to a driving state according to the pixel information depending on the level of the source signal which is a pixel voltage or pixel signal applied to the TFTs through the source gate bus line. An electric potential according to such a driving state is given to the pixel electrode by the drain electrode. The orientation of the liquid crystal medium is controlled for each pixel electrode by an electric field of intensity determined by the difference between this pixel electrode potential and the voltage level applied to the common electrode. The liquid crystal material can modulate the back irradiating light from the backlight system and external light from the front side for each pixel according to the pixel information.

This liquid crystal display device has a basic arrangement made up of a timing control section 11, first and second RAMs 12, 13 which are storage sections for storing image data, a latch circuit 14 which latches image data, a source driver 15 as column driving means, and a gate driver 16 as row driving means. Furthermore, the liquid crystal display device is provided with a switch SW1 which transfers image data by switching between the first RAM 12, second RAM 13 and latch circuit 14. The first RAM 12 and second RAM 13 which are a plurality of storing means preferably have the capacity capable of storing image data corresponding in number to successive lines at application timings of the image data during a time-series operation process.

Figure 2:
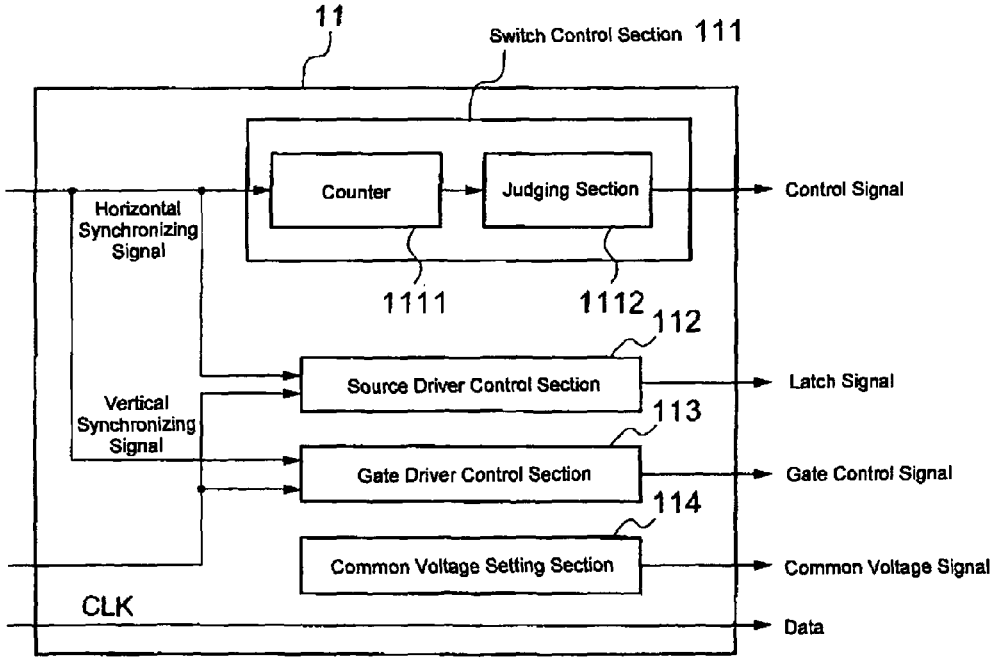
FIG. 2 is a block diagram showing an arrangement of a timing control section in the liquid crystal display device of FIG. 1.

FIG. 2 is a schematic block diagram showing the internal arrangement of the timing control section 11 shown in FIG. 1. The timing control section 11 includes a switch control section 111 which controls switching of the switch SW1, a source driver control section 112 which generates a latch signal which synchronously operates the source driver 15 using a synchronizing signal and clock signal (CLK), a gate driver control section 113 which generates a gate control signal for controlling the gate driver 16 using the synchronizing signal and clock signal, and a common voltage setting section 114 which sets a voltage of the common electrode. The switch control section 111 includes a counter 1111 which counts a horizontal synchronizing signal and a judging section 1112 which generates a control signal for switching the switch SW1 so as to transfer data to the first RAM 12, second RAM 13 or latch circuit 14 based on the information counted by the counter 1111. Furthermore, the timing control section 11 transfers image data signals for red (R), green (G) and blue (B) from signal applying means (not shown) to the switch SW1. The timing control section 11 generates and supplies a reference voltage, etc., used for the source driver 15 and gate driver 16, explanations of which will be omitted here.

The first RAM 12 and second RAM 13 receive image data signals of R, G, B from the timing control section 11 and sequentially stores the respective colors for every horizontal scanning period. Image data are stored in the first RAM 12 and second RAM 13 using the counter 1111 and judging section 1112 of the switch control section 111. That is, the image data are decided to be transferred to the first RAM 12, second RAM 13 or latch circuit 14 based on the horizontal synchronizing signal. More specifically, the counter 1111 counts the horizontal synchronizing signal first and sends information on the count value to the judging section 1112. The judging section 1112 judges to which of the first RAM 12, second RAM 13 or latch circuit 14 the image data should be transferred based on the count value information from the counter 1111. The judged information is sent from the judging section 1112 to the switch SW1 as a control signal.

The switch SW1 switches between transfer destinations of the image data according to the control signal from the judging section 1112. For example, in the arrangement in FIG. 1, the SW1 is switched to A when the image data are transferred to the first RAM 12, the SW1 is switched to B when the image data are transferred to the second RAM 13 and the SW1 is switched to C when the image data are transferred to the latch circuit 14.

The latch circuit 14 applies specific data processing (time-series operation process) based on the control signal (latch signal) from the timing control section 11. The latch signal is generated by the source driver control section 112 of the timing control section 11 using a horizontal synchronizing signal and a clock signal. This time-series operation process is the processing according to a matrix driving method for alternately driving pixels arranged in matrix which successively sequences on a time series a supply timing of pixel data for one row electrode and a supply timing of pixel data for the other row electrode to be in the same polarities as the pixel data for the one row electrode and activates the corresponding row electrode in response to each of the supply timings of the pixel data for the one and the other row electrodes. This time-series operation process is described in detail in Unexamined Japanese Patent Publication No. 2003-114647 by the present inventor, the entire disclosure of which is incorporated herein by reference in its entirety. The image data subjected to such data processing are transferred to the source driver 15.

The source driver 15 has a digital-analog converter for each of image data R, G, B. The image data of each color are converted to an analog signal by the digital-analog converter for every horizontal scanning period and a pixel data group carrying a group of pixel information pieces (that is, pixel information corresponding to 1 line) to be displayed for one horizontal scanning period is generated for each color. These pixel data are stored in TFTs until the next horizontal scanning period and are supplied to the corresponding source bus line. A control signal supplied from the latch circuit 14 to the source driver 15 is intended to present the horizontal scanning period in display operations such as analog conversion and voltage supplied to the source bus line, to the source driver 15.

The gate driver 16 selectively activates a gate bus line on the display panel 17 according to a gate control signal from the gate driver control section 113 of the timing control section 11 and selectively supplies, for example, a predetermined high voltage to the bus line. The activated gate bus line turns ON each corresponding TFT and enables the source signals supplied to these TFTs to simultaneously drive the TFTs relevant to the one line. This causes the pixels of the row relevant to the activated gate bus line to be optically modulated according to the pixel information relevant to the one line. The control over the gate driver 16 by the gate control signal from the timing control section 11 will be described later.

Then, the operation of the liquid crystal display device having the above-mentioned arrangement will be explained. Here, a case will be explained wherein a time-series operation process is carried out on a 6-line block, the first RAM 12 and second RAM 13, which are a plurality of storage sections, consist of a 6-line buffer respectively and the pixel arrangement is 130 RGB×130.

The image data to be displayed on the display panel 17 are sent to the timing control section 11. Furthermore, a clock signal and a synchronizing signal for displaying the image data on the display panel 17 are input to the timing control section 11. The clock signal is sent to the source driver control section 112 and gate driver control section 113 of the timing control section 11. Furthermore, of the synchronizing signals, the horizontal synchronizing signal is sent to the counter 1111 and source driver control section 112 of the switch control section 111. The vertical synchronizing signal is sent to the gate driver control section 113.

The counter 1111 counts the horizontal synchronizing signal and sends the count value to the judging section 1112. The judging section 1112 sends a control signal to the switch SW1 based on the count value for switching the switch SW1 so that the image data for row electrodes having the same polarity are stored in the same buffer. The switching control of this switch SW1 will be explained using FIG. 3 and FIG. 4.

Figure 3:
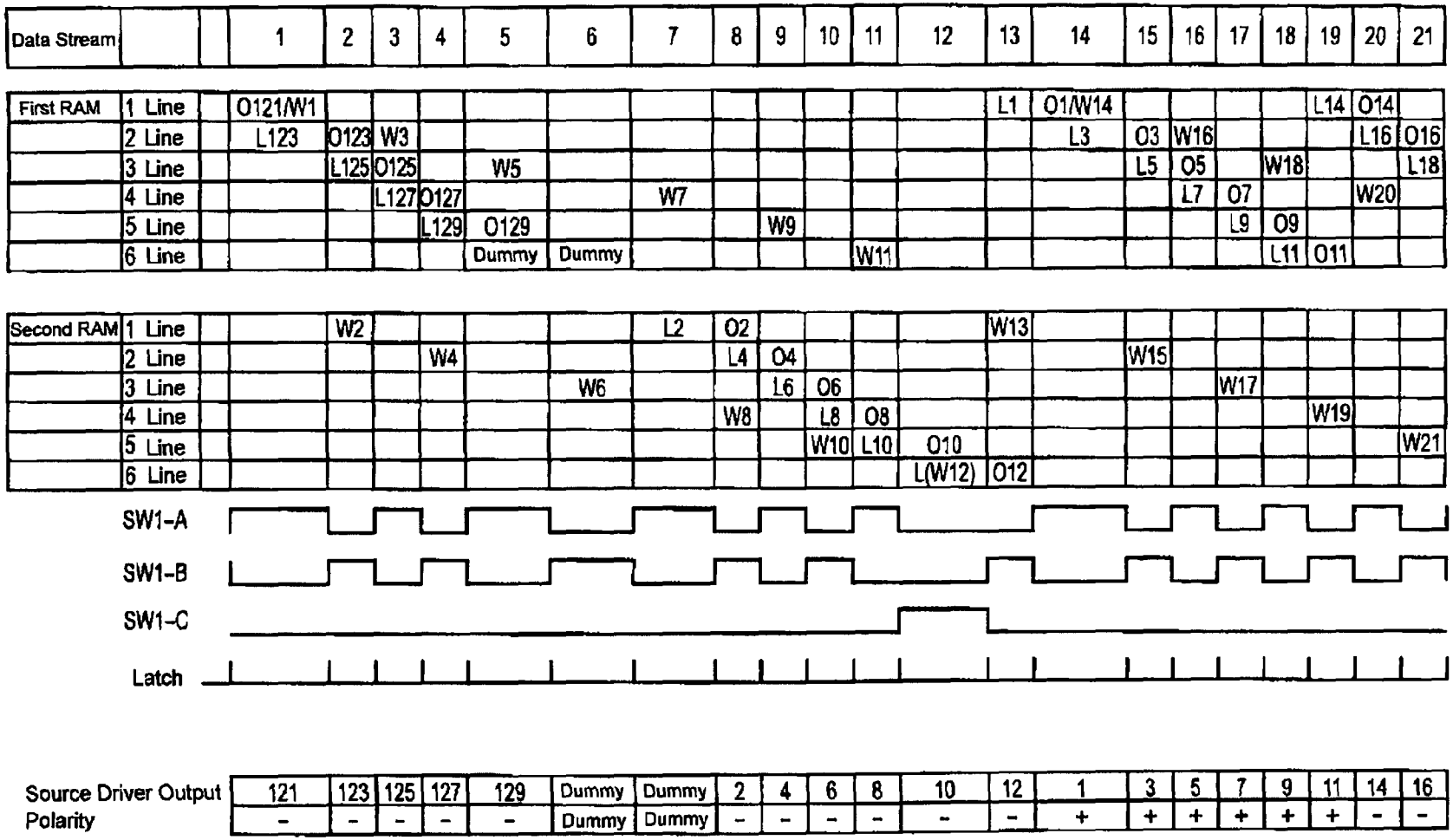
FIG. 3 is a view of explaining the storing operation of the pixel data in the liquid crystal display device according to an Embodiment of the present invention.
Figure 4:
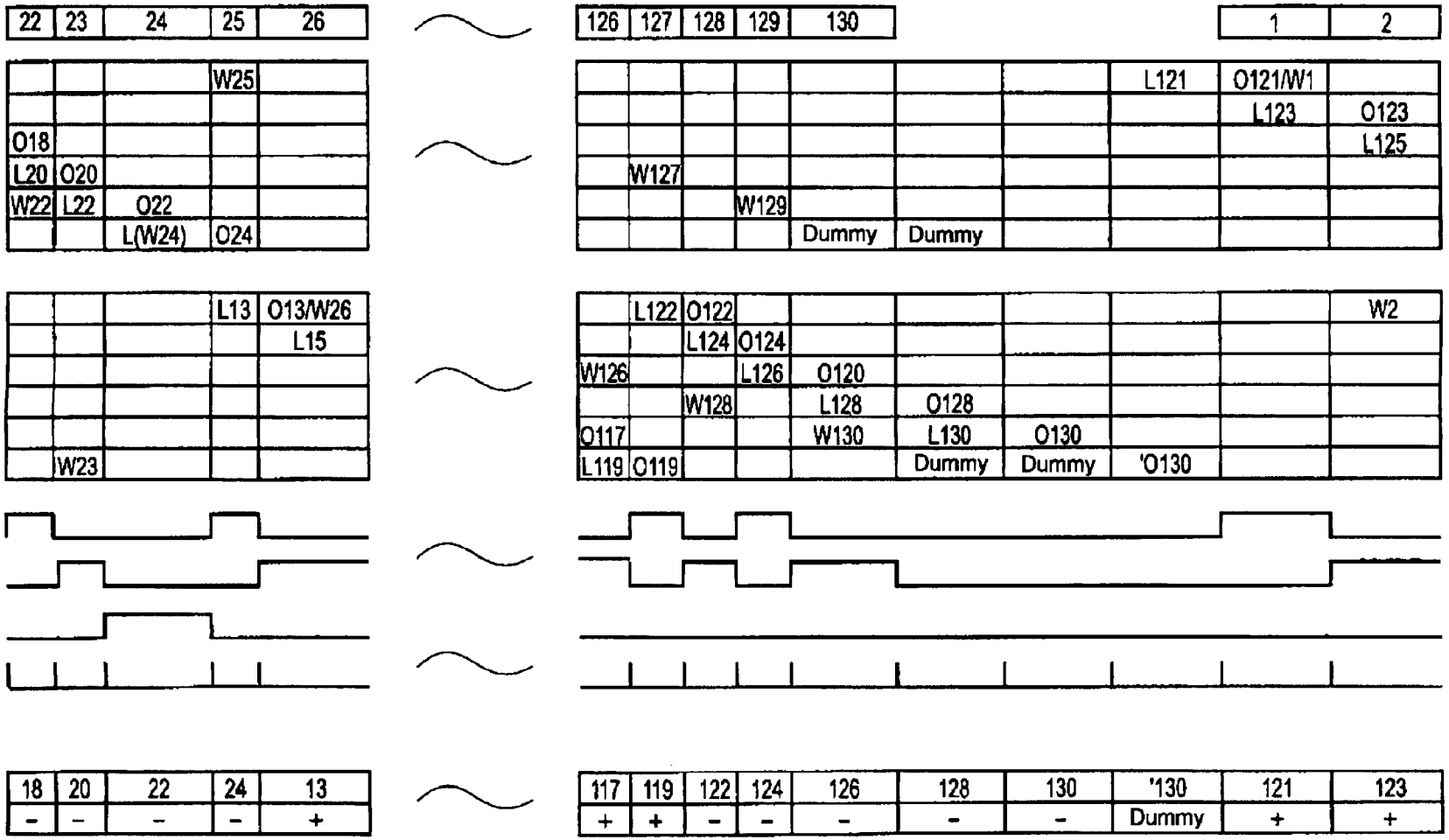
FIG. 4 is a view of explaining the storing operation of the pixel data in the liquid crystal display device according to an Embodiment of the present invention.

FIGS. 3 and 4 are views of explaining the storing operation of the pixel data in the liquid crystal display device according to an Embodiment of the present invention. In FIG. 3 and FIG. 4, 'Wn' denotes a timing at which the image data is written in the RAM, 'Ln' denotes a timing at which the image data are transferred from the RAM to the latch circuit 14, 'L(Wn)' denotes a timing at which the image data are directly written in the latch circuit 14, 'On' denotes a timing at which the image data are output from the latch circuit 14 to the display panel 17 and 'On/Wn' denotes a timing at which the image data are output from the latch circuit 14 to the display panel 17 and at the same time the image data are written in the RAM. These timings are controlled by the timing control section 11 using a control signal to the switch SW1, a latch signal (and control signal to the source driver 15) to the latch circuit 14 and a gate control signal to the gate driver 16.

Here, a case wherein matrix driving is performed with even rows driven with negative polarities and odd rows driven with positive polarities will be explained.

A horizontal synchronizing signal counted by the counter 1111 corresponds to a data stream number in FIG. 3. For this reason, when the count of a horizontal synchronizing signal by the counter 1111 is an odd number, a data stream having an odd number is written in the first RAM 12 first. For example, when one horizontal synchronizing signal is counted, a data stream 1 (data on the first line) is written in the first RAM 12 (see W1, W3, . . . , W11 in FIG. 3). That is, when the count value 1 counted by the counter 1111 is sent to the judging section 1112, the judging section 1112 generates a control signal for switching the switch SW1 so that the data stream 1 is written in the first RAM 12 and sends the control signal to the switch SW1. The switch SW1 performs switching based on the control signal (state A).

Next, a data stream 13 having an odd number (here, the seventh odd number, that is, 13th) exceeding the number of line buffers of the first RAM is written in the second RAM 13. For example, when 13 horizontal synchronizing signals are counted, the data stream 13 (data on the 13th line) is written in the second RAM 13 (see W13, W15, . . . , W23 in FIG. 3). That is, when the count value 13 counted by the counter 1111 is sent to the judging section 1112, the judging section 1112 generates a control signal for switching the switch SW1 so that the data stream 13 (data on the 13th line) is written in the second RAM 13 and sends the control signal to the switch SW1. The switch SW1 performs switching based on the control signal (state B).

When the count of a horizontal synchronizing signal by the counter 1111 is an even number, a data stream having an even number is written in the second RAM 13 first. For example, when two horizontal synchronizing signals are counted, a data stream 2 (data on the second line) is written in the second RAM 13 (see W2, W4, . . . , W10 in FIG. 3). That is, when the count value 2 counted by the counter 1111 is sent to the judging section 1112, the judging section 1112 generates a control signal for switching the switch SW1 so that the data stream 2 is written in the second RAM 13 and sends the control signal to the switch SW1. The switch SW1 performs switching based on the control signal (state B).

Next, a data stream 14 having an even number (here, the seventh even number, that is, 14th) exceeding the number of line buffers of the second RAM is written in the first RAM. For example, when 14 horizontal synchronizing signals are counted, the data stream 14 (data on the 14th line) is written in the first RAM 12 (see W14, W16, W22 in FIG. 3). That is, when the count value 14 counted by the counter 1111 is sent to the judging section 1112, the judging section 1112 generates a control signal for switching the switch SW1 so that the data stream 14 is written in the first RAM 12 and sends the control signal to the switch SW1. The switch SW1 performs switching based on the control signal (state A).

When the counter 1111 counts 12 horizontal synchronizing signals (total number (12) of line buffers of the first RAM 12 (6 lines) and second RAM (6 lines)), the data stream 12 (data on the 12th line) is transferred to the latch circuit 14 (see L(W12) in FIG. 3). This is done because the timing for writing on an even line overlaps with the timing for transferring to the latch circuit 14. That is, when the count value 12 counted by the counter 1111 is sent to the judging section 1112, the judging section 1112 generates a control signal for switching the switch SW1 so that the data stream 12 is directly transferred to the latch circuit 14 and sends the control signal to the switch SW1. The switch SW1 performs switching based on the control signal (state C). In this way, when the counter 1111 counts horizontal synchronizing signals corresponding in number to a maximum number of line buffers, the count value is sent to the judging section 1112, the judging section 1112 generates a control signal for switching the switch SW1 so that the data stream is transferred to the latch circuit 14, sends the control signal to the switch SW1 and the switch SW1 is switched based thereon. This is done in the same way for data streams whose number is a multiple of 12 which is a total number of the line buffers.

The data streams written in the first RAM 12 and second RAM 13 as described above are transferred to the latch circuit 14 by a latch signal from the timing control section 11. The data streams transferred to the latch circuit 14 are output to the source driver 15. This output is performed in such a way that a time-series operation process is performed. In FIG. 3, the data streams are output at a timing immediately following the timing of the transfer to the latch circuit 14 (the Ln timing is immediately followed by the On timing).

Furthermore, the pixel arrangement here is 130 RGB×130. In this case, the timing for proceeding to the next frame is as shown in FIG. 4. That is, in this case, the image data are written in the first RAM 12 and second RAM 13 with each 5 lines. Therefore, dummy data are written on the sixth lines of the first RAM 12 and second RAM 13. Since the mode of writing of the last portion of a frame differs depending on the pixel arrangement, it is not limited to the mode shown in FIG. 4 and can be modified according to the pixel arrangement as appropriate.

Thus, the liquid crystal display device according to the present invention writes image data (data streams) on odd rows in the first RAM 12, on even rows in the second RAM 13 for the first to 11th lines. For the image data on the 12th row, it controls the switch SW1 to perform switching so that image data is directly transferred to the latch circuit 14. Furthermore, for the 13th to 23rd lines, the liquid crystal display device of the present invention writes image data on odd rows in the second RAM 13, writes image data on even rows in the first RAM 12. For the image data on the 24th row, it controls the switch SW1 to perform switching so that the image data is directly transferred to the latch circuit 14. This operation is repeated. Furthermore, the image data written in the first RAM 12 and second RAM 13 are transferred to the latch circuit 14, subjected to a time-series operation process and output to the source driver 15.

Thus, by controlling timings of writing in the RAMs 12, 13, transferring to the latch circuit 14 and outputting to the source driver 15, it is possible to output the same polarities to the source driver 15 successively as shown in FIG. 3 and FIG. 4 and realize a time-series operation process. That is, the time-series operation process is performed in a six-line block, and therefore the polarities of the outputs of the source driver are the same as those of 6 data streams.

This allows power consumption to be reduced during matrix driving. Furthermore, image data are output to the source driver efficiently using two 6-line buffers, and therefore it is possible to realize processing in real time compared to the conventional method whereby an entire frame is latched into the latch circuit and then output to the source driver and also applicable to the RGB I/F. Furthermore, since one frame memory is not necessary, it is possible to reduce the area of the IC chip.

The present invention is not limited to the above-described embodiment, but can be implemented modified in various ways. For example, the above described embodiment has explained the case where the storage section consists of two buffers of the first RAM 12 and second RAM 13, and the first RAM 12 and second RAM 13 each consists of a 6-line buffer, but the present invention may also have a storage section consisting of three or more buffers capable of storing polarities of row electrodes all together and is also applicable to a case where each buffer is other than a 6-line buffer. Furthermore, the above-described embodiment has explained the case where the pixel arrangement is 130 RGB×130, but the present invention is also applicable to a pixel arrangement other than this. In this case, the writing mode of the last portion of a frame is also changed according to the pixel arrangement.

The invention claimed is:

1. A liquid crystal display device for matrix driving to alternately drive pixels arranged in matrix, wherein a plurality of row electrodes extending in a horizontal direction of a display screen are made to be selectively active for each horizontal scanning period of images to be displayed; a plurality of column electrodes extending in a vertical direction of the display screen are supplied with respective pixel data which are correspond to the image and relevant to the horizontal scanning period while the pixel data have polarities alternating for each frame period of the images; and the pixel data have polarities alternating in the vertical direction spatially in a display area within the frame period, the device comprising:

a plurality of storing means for storing the pixel data relevant to row electrodes having the same polarities, wherein the plurality of storing means comprises a first storing means and a second storing means;

latch means to which the pixel data are transferred; and timing control means for controlling the timing such that the pixel data relevant to row electrodes having the same polarities are written in said plurality of storing means or said latch means, wherein matrix driving is performed in such a way that the device is successively sequencing on a time series a supply timing of pixel data for one row electrode and a supply timing of pixel data for the other row electrode having the same polarities as the pixel data for the one row electrode, and activates the relevant row electrode in response to each of the supply timings of the pixel data for the one and the other row electrodes; and said first storing means stores the pixel data on odd rows and said second storing means stores the pixel data on even rows, then said latch means stores pixel data on one row, after that said first storing means stores the pixel data on even rows and said second storing means stores the pixel data on odd rows.

2. A liquid crystal display device as claimed in claim 1, wherein said timing control means comprises counter means for counting horizontal synchronizing signal, and judging means for judging the destination of pixel data on the basis of a count value of said horizontal synchronizing signal.

3. A liquid crystal display device as claimed in claim 1, wherein each of said plurality of storing means has the capacity that is able to store the image data corresponding in number to successive lines of supply timing of the image data.

4. A liquid crystal display device as claimed in claim 2, wherein each of said plurality of storing means has the capacity that is able to store the image data corresponding in number to successive lines of supply timing of the image data.

* * * * *